US006970077B2

(12) United States Patent
Johnson et al.

(10) Patent No.: US 6,970,077 B2
(45) Date of Patent: Nov. 29, 2005

(54) ENVIRONMENTAL CONDITION ALARM WITH VOICE ENUNCIATION

(75) Inventors: Derek Scott Johnson, Aurora, IL (US); Floyd Edward Brooks, Montgomery, IL (US); Michael A. Swieboda, Naperville, IL (US)

(73) Assignee: BRK Brands, Inc., Aurora, IL (US)

( * ) Notice: Subject to any disclaimer, the term of this patent is extended or adjusted under 35 U.S.C. 154(b) by 548 days.

(21) Appl. No.: 10/071,492

(22) Filed: Feb. 7, 2002

(65) Prior Publication Data

US 2003/0146833 A1 Aug. 7, 2003

(51) Int. Cl.[7] ..... G08B 23/00

(52) U.S. Cl. ..... 340/500; 340/517; 340/521; 340/286.11

(58) Field of Search ..... 340/500, 460, 340/506, 517, 521, 539.22, 3.1, 286.11

(56) References Cited

U.S. PATENT DOCUMENTS

| | | | | |
|---|---|---|---|---|
| 4,772,876 A | * | 9/1988 | Laud | 340/539.22 |
| 4,901,056 A | | 2/1990 | Ballavia et al. | |
| 4,904,988 A | | 2/1990 | Nesbit et al. | |
| 5,349,338 A | | 9/1994 | Routman et al. | |
| 5,594,410 A | * | 1/1997 | Lucas et al. | 340/332 |
| 5,663,714 A | | 9/1997 | Fray | |
| 5,786,768 A | | 7/1998 | Chan et al. | |
| 6,043,750 A | | 3/2000 | Mallory | |
| 6,097,289 A | | 8/2000 | Li et al. | |
| 6,121,885 A | | 9/2000 | Masone et al. | |
| 6,144,310 A | | 11/2000 | Morris | |
| 6,307,482 B1 | | 10/2001 | Le Bel | |
| 6,323,780 B1 | * | 11/2001 | Morris | 340/692 |
| 6,522,248 B1 | * | 2/2003 | Andres et al. | 340/521 |
| 6,529,128 B2 | * | 3/2003 | Weng | 340/539.1 |
| 6,784,798 B2 | * | 8/2004 | Morris | 340/628 |

FOREIGN PATENT DOCUMENTS

| | | |
|---|---|---|
| GB | 2 317 984 A | 4/1998 |
| GB | 2 352 551 A | 1/2001 |
| JP | 58002545 | 1/1983 |

OTHER PUBLICATIONS

Search Report dated Apr. 16, 2003 for British Counterpart Application GB 0229278.7 of the above entitled application. Examination report from British Patent Office dated Dec. 21, 2004 in counterpart GB patent application.

* cited by examiner

*Primary Examiner*—Daryl C Pope
(74) *Attorney, Agent, or Firm*—Lawrence J. Shurupoff

(57) ABSTRACT

An ambient condition detector can provide verbal feedback to a user or consumer indicative of an alarm condition being sensed beyond the existence of a predetermined alarm condition and/or location. Information pertaining to developing alarm conditions whether gas or fire, that are being sensed can be verbally fed back to the consumer either automatically or in response to incident infrared control signals directed to the detector by the consumer. Additional status and/or parametric information can be provided by the consumer in response to incoming infrared command signals.

14 Claims, 2 Drawing Sheets

ENVIRONMENTAL CONDITION ALARM WITH VOICE ENUNCIATION

FIELD OF THE INVENTION

The invention pertains to ambient condition detectors with voice output. More particularly, the invention pertains to such detectors wherein synthesized voice can be used to provide parametric or status information for a respective detector.

BACKGROUND OF THE INVENTION

Ambient condition detectors have become wide-spread and are used in residences for sensing the presence of potentially dangerous ambient conditions such as gas or fire. Many known detectors provide a tonal or pulsed alarm output in the presence of a predefined, potentially dangerous, ambient condition. Some detectors provide additional information as to condition and location of the condition using synthesized speech. One such detector has been disclosed and claimed in Morris U.S. Pat. No. 6,144,310 entitled "Environmental Condition Detector With Audible Alarm and Voice Identifier".

Gas detectors are known which include numeric displays for the purpose of providing visual information pertaining to gas concentration. For example, a level of gas, in parts per million and/or mode of operation of the detector can be visually presented using such displays.

One recognized deficiency of known detectors with visual displays arises from the location of the respective detector when in use. AC powered gas detectors are often plugged into AC receptacles, which are installed near the floor. On the other hand, smoke detectors are usually installed on a ceiling to take advantage of the propensity of airborne particulate matter such as smoke to rise. Neither of these locations is particularly conducive to directly viewing a detector mounted display.

Known alternates such as incorporating larger displays or backlighting the displays to make the alphanumerics being presented easier to read, apart from being just a partial solution to the problem, increase the price of the respective detector. They may also increase energy requirements which impose additional drains and shorten battery life in battery powered detectors.

There continues to be a need for ambient condition detectors which can in a user friendly way, provide additional information as to condition being sensed and detector status than has heretofore been possible. Preferably, such fuctionality would provide as much as or more information than known detectors having a visual display without exhibiting the drawbacks of a visual display given the typical locations where such detectors are usually installed. Preferably, additional parametric or status information would be provideable to a user without a commensurate increase in detector cost.

SUMMARY OF THE INVENTION

An ambient condition detector incorporates a housing which carries an ambient condition sensor, control circuitry coupled to the sensor, and voice output circuitry coupled to the control circuitry. The voice output circuitry can provide dynamic on-going feedback to a user in the vicinity of the respective detector as to, for example and without limitation, real time parts per million of detected gas, peak parts per million values, mode of operation of the detector, temperature, humidity, level of detected smoke, status of sensors, other components, power supply and time of day. Power can be supplied to the respective detector via self contained batteries or by utility supplied AC.

One embodiment of a detector in accordance with the invention incorporates a radiant energy input port, such as infrared, whereat command signals generated by a remote source can be received. The command signals can direct the respective detector to audibly output one or more selected parameters, status indicators or the like, as required by the user and in the absence of an alarm condition.

Using the radiant energy input port, the end user or consumer can easily program the location of the detector enabling it to provide audible feedback as to the location of a selected ambient condition. Other feedback information, audibly available, in response to received infrared signals includes battery status, status of the sensor or sensors and any other desired internal detector parameters.

In one embodiment, the housing can carry two or more sensors. One sensor can be directed to selected gas. Another sensor can be directed to ambient smoke. A third sensor, if desired, can be directed to sensing temperature or ambient humidity.

In response to sensing a predetermined condition such as gas or smoke, the respective detector can, upon entering an alarm state, emit one or more different audible alarms, associated with a respective sensed ambient condition. Audio information as to type of condition and location of the condition can be interleaved in silent intervals either between audible alarm indicators such as tones or between groups of tones.

The detectors can be interconnected without any need for an alarm control unit. In this embodiment, a consumer using a remote unit can request voice feedback as to status or other information pertaining to displaced interconnected detectors.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
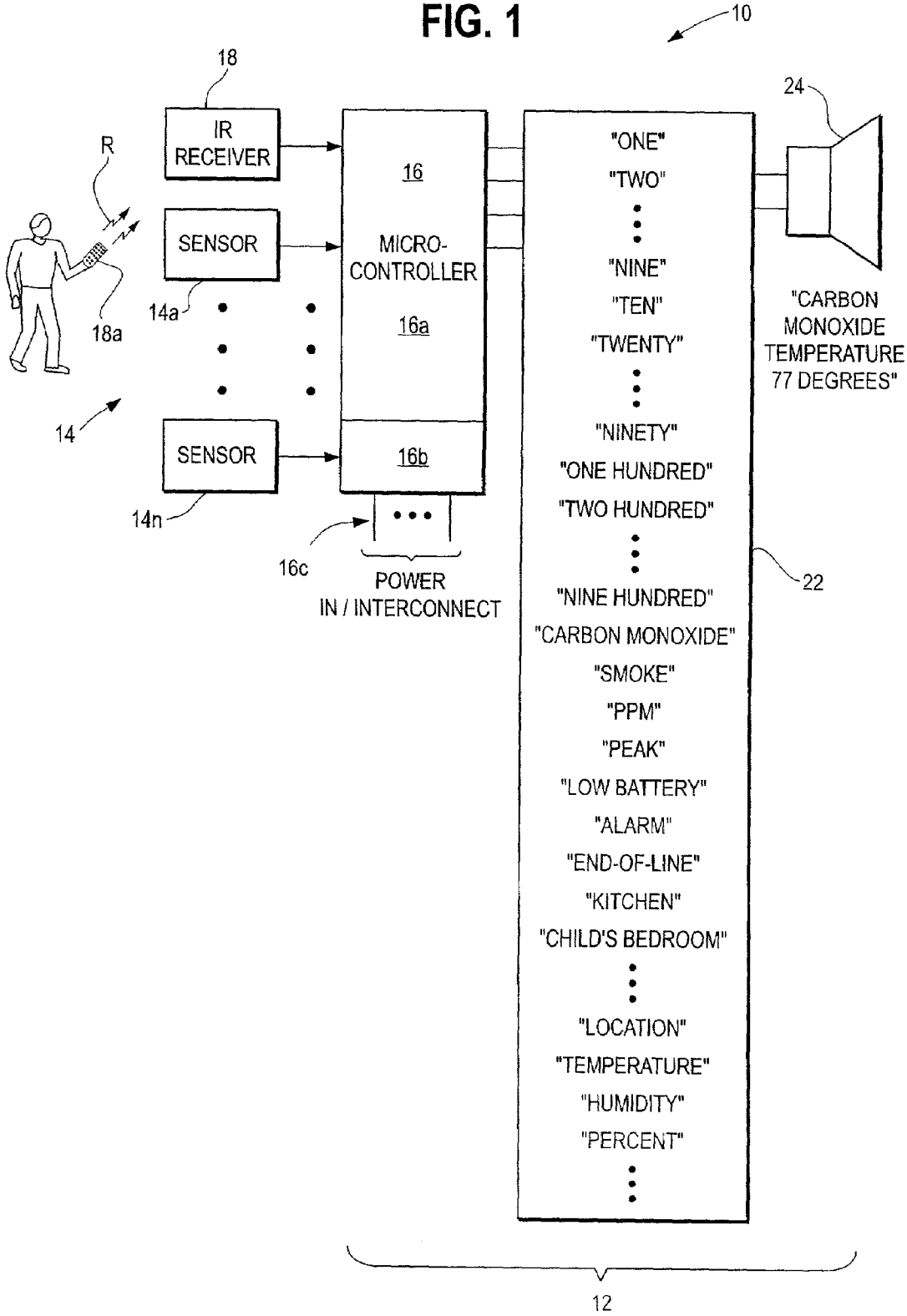
FIG. 1 is a block diagram of a detector in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a detector 10 in accordance with the present invention. The detector 10 is self-contained in a housing 12 which is mountable on a surface, such as a ceiling, or, an AC receptacle in the event that the detector 10 carries AC prongs.

The detector 10 includes one or more sensors 14*a* . . . 14*n*. The sensors 14 respond to a variety of ambient conditions including airborne gas, temperature, humidity, as well as smoke indicative of fire. Outputs from the sensors 14 are coupled to control circuitry 16 which can incorporate a programmed processor 16*a*.

Processor 16*a* can include inboard or outboard programmable read-only memory or read-only memory indicated generally at 16*b* for storage of executable instructions, a control program. Those of skill in the art will understand that control circuitry 16 would include, as desired, interface circuitry for coupling to sensors 14.

Detector 10 can also include a radiant energy sensor such as an infrared receiver 18. Receiver 18 is responsive to a remote control unit 18a*a*, for example of a type which generates infrared signals. Use of the displaced or remote radiant energy source 18*a* is discussed in more detail subsequently.

Control circuitry 16 can also incorporate sensing circuitry for sensing characteristics of input power at input port 16*c* which can be derived from utility supplied AC and/or a battery carried in housing 12. A low battery signal, or loss of utility supplied AC can also be sensed by control circuitry 16.

Control circuitry 16 is also coupled to voice synthesizing circuitry 22 which is in turn coupled to an output transducer, such as a speaker 24. Voice synthesizing circuitry 22, responsive to control signals received from control circuitry 16 can emit, as audible output, human discernable speech. The audible outputs can include parametric information pertaining to sensor condition, ambient condition(s) being sensed, type of ambient condition being sensed, status information pertaining to available power or alarm state. Other audible outputs include location information, all without limitation.

Detector 10 is particularly user friendly in that while mountable on a ceiling for detection of heat or ambient smoke or mountable on an AC receptacle near floor level for detection of gas, the user or consumer can readily obtain information from the detector 10 via voice output circuitry 22. The available voice feedback obviates any need for large and expensive visual displays.

The user or consumer requests the desired parametric or status information using remote control 18*a*. Detector 10 responds to incident radiation R. Control circuitry 16 determines the received command and can, in response thereto, verbally provide gas levels in parts per million, ambient smoke density, diagnostic information such as condition or status of input power, AC or battery, or status or condition of the various sensors or components in the detector 10. Additionally, the consumer via the remote 18*a* can program the detector 10 with the location during installation. The consumer can also program the detector 10 to announce one or more prestored alarm conditions consistent with the sensors 14 available in the unit.

The detector 10, in response to remote control 18*a* can provide the parametric and/or status verbal feedback to the consumer or user when the unit is not in an alarm condition. Both location flexibility and consumer friendliness are enhanced by the availability of voice feedback, as described above, on demand.

Figure 2:
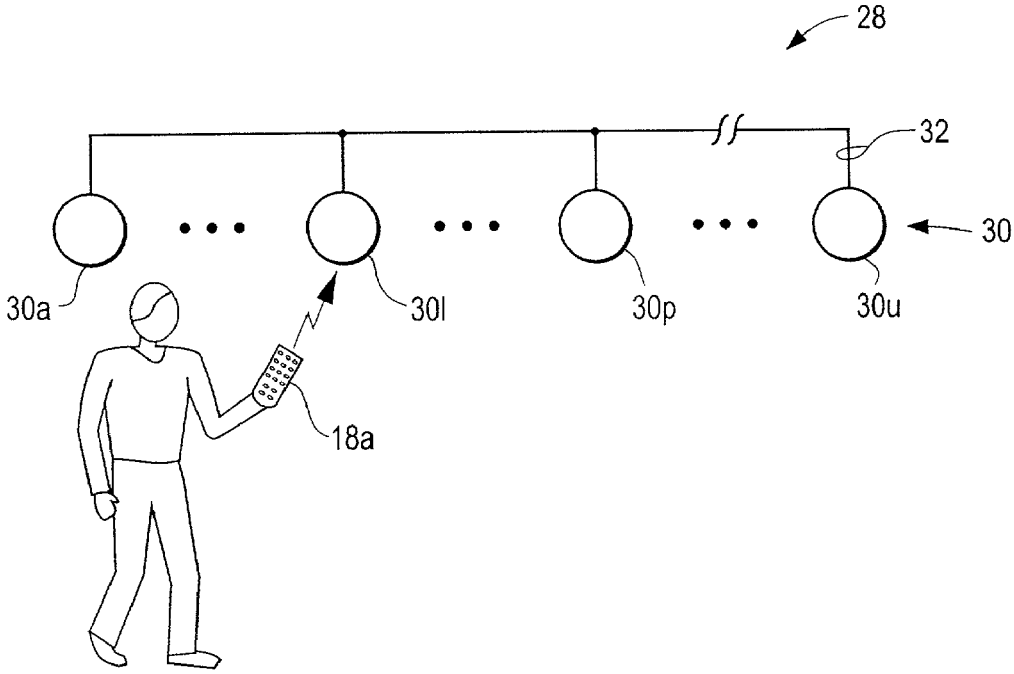
FIG. 2 is a diagram of a system which incorporates a plurality of detectors such as the detector of FIG. 1.

FIG. 2 illustrates an interconnected detector system 28 which incorporates a plurality of substantially identical detectors 30. The members of the plurality 30 are substantially identical to the detector 10. In the system 28, the detectors are each interconnected via port 16*c*. They can be powered off of self-contained batteries or utility supplied AC power via interconnect cable 32.

A user, via wireless remote control unit 18*a* is not only, in the system 30, able to receive verbal feedback from a detector 301 in the vicinity of the user and in the vicinity of the remote 18*a*. Additionally, the user via the commands sent from the remote 18*a* can receive verbal feedback from detector 301 which pertains to other interconnected detectors such as the detector 30*p* or the detector 30*u* which might be in other displaced portions of a residence or building wherein the detectors are located. Hence, the user, via detector 301 could determine that detector 30*p* needs replacement batteries or, is exhibiting a malfunction of a predetermined type without having to go to the respective detector and either visually examine a display thereon, such as a light emitting diode or an alphanumeric display or listen for audible feedback at the respective detector. Thus, a user's ability to obtain verbal feedback from the components of the system 28 is substantially enhanced using the remote control unit 18*a*.

It will be understood that while the remote control unit 18*a* can be an infrared based command device, that other forms of wireless communication such as visible light, RF or ultrasonics could be used without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An ambient condition detector comprising:

at least one ambient condition sensor;

control circuitry coupled to the sensor for receiving electrical signals there from indicative of a sensed condition, and for determining the existence of a predetermined alarm condition;

voice output circuitry, coupled to the control circuitry, wherein the control circuitry, in response to a selected signal, couples at least one of sensor related parametric value information, or detector status information to the voice output circuitry for audible output as human discernable speech;

a radiant energy receiving port, coupled to the control circuitry for receiving radiant energy from a remote source and for generating the selected signal in response thereto; and which includes circuits for specifying a detector installation location in response to received radiant energy signals.

2. A detector as in claim 1 wherein the sensor is one of a gas sensor, a heat sensor, a humidity sensor, and a smoke sensor.

3. A detector as in claim 1 which includes a second, different sensor coupled to the control circuitry.

4. A detector as in claim 1 which includes circuitry, coupled to the voice output circuitry for producing an audible, location confirming output as human discernable speech.

5. A detector as in claim 1 wherein detector status information is selected from a class which includes battery status, sensor status, and control circuitry status.

6. A detector as in claim 1 which includes a housing which defines an internal volume wherein the at least one sensor, the control circuitry and the voice output circuitry are carried.

7. A detector as in claim 1 which includes circuitry, coupled to the voice output circuitry, for emitting an alarm-type audible output as human discernable speech.

8. A detector as in claim 1 which includes circuitry, coupled to the voice output circuitry, for emitting an alarm location audible output as human discernable speech.

9. A speech oriented ambient condition detector comprising:

a housing;

at least a smoke sensor and a gas sensor carried by the housing;

circuitry for identifying housing location;

circuitry for receiving signals from the sensors and for ascertaining the presence of at least one predetermined alarm condition and for storing parametric information pertaining to status of at least one of a sensor, a battery condition, and circuit condition; and voice circuitry for generating human discernable speech output of at least housing location and numeric ambient condition information associated with one of the sensors.

10. A detector as in claim 9 which includes circuitry wherein the numeric ambient condition information can be verbalized in the absence of any alarm condition and in response to a selected condition.

11. A detector as in claim 10 wherein the selected condition comprises a selected, remotely generated radiant energy signal.

12. An ambient condition detector comprising:

control circuitry;

at least one ambient condition sensor;

a voice output element, coupled to the control circuitry for providing user induced, non-alarm, verbal, monitoring outputs; and a signal line, coupled to the control circuitry, for conveying a user induced, verbal output initiating signal thereto from a displaced location.

13. A detector as in claim 12 wherein the voice output element includes storage of ambient condition, non-alarm, monitoring messages.

14. A detector as in claim 12 wherein an electronic switch is coupled to the signal line.

* * * * *